US006171773B1

(12) United States Patent
Bergthaller et al.

(10) Patent No.: US 6,171,773 B1
(45) Date of Patent: Jan. 9, 2001

(54) COLOR PHOTOGRAPHIC PRINT MATERIAL

(75) Inventors: Peter Bergthaller, Gladbach; Jürgen Jung, Leverkusen; Edgar Draber, Odenthal; Jörg Hagemann, Köln; Ulrich Nickel, Erlangen, all of (DE)

(73) Assignee: Agfa N.V (BE)

( * ) Notice: Under 35 U.S.C. 154(b), the term of this patent shall be extended for 0 days.

(21) Appl. No.: 09/304,592

(22) Filed: May 4, 1999

(30) Foreign Application Priority Data

May 4, 1998 (DE) ..... 198 19 830

(51) Int. Cl.[7] ..... G03C 1/08; G03C 7/26; G03C 7/32

(52) U.S. Cl. ..... 430/549; 430/558; 430/556; 430/557; 430/551

(58) Field of Search ..... 430/503, 505, 430/543, 558, 551, 556, 557, 549

(56) References Cited

U.S. PATENT DOCUMENTS 5,372,920 * 12/1994 Edwards ..... 430/558
5,429,915 * 7/1995 Shibahara et al. ..... 430/558
5,451,501 * 9/1995 Miukawa et al. ..... 430/558

FOREIGN PATENT DOCUMENTS 0 628 867 12/1994 (EP) .

* cited by examiner

*Primary Examiner*—Geraldine Letscher
(74) *Attorney, Agent, or Firm*—Connolly Bove Lodge & Hutz

(57) ABSTRACT

A colour photographic material which contains at least one pyrrolo[1,2-b]-1,2,4-triazole cyan coupler of the formula (I)

(I)

in which $R_1$, X and Y have the meaning stated in the description, is distinguished by excellent reproduction of blue and cyan tones if a 2-equivalent yellow coupler is added to the layer containing the couplers of the formula (I).

12 Claims, No Drawings

COLOR PHOTOGRAPHIC PRINT MATERIAL

BACKGROUND OF THE INVENTION

This invention relates to a colour photographic print material containing at least one pyrrolo[1,2-b]-1,2,4-triazole as the cyan coupler.

Colour photographic print materials are in particular materials for producing colour reflection prints or display images which most frequently have a positive image. They are thus not recording materials like colour photographic films.

Pyrrolo[1,2-b]-1,2,4-triazoles are cyan couplers known, for example from EP 628 867, which yield very clear cyan dyes having a relatively short-wave absorption band and very high absorbance and thus allow economies of silver halide to be made. The cyan dyes of these couplers additionally exhibit very good stability when stored in darkness.

A disadvantage is that these couplers result in distorted colour reproduction of blue and cyan tones.

The object of the invention is to remedy this disadvantage so that the advantages of these couplers may be exploited.

It has surprisingly now been found that this object may be achieved in a material of the above-stated type having at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, which material contains in the red-sensitive layer, of which there is at least one, at least one pyrrolo[1,2-b]-1,2,4-triazole cyan coupler of the formula (I)

(I)

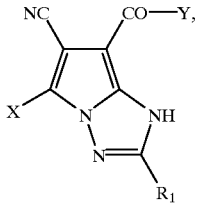

in which $R_1$ means hydrogen or a substituent,

X means a hydrogen atom or a leaving group and

Y means $OR_2$ or

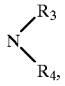

wherein $R_2$ means

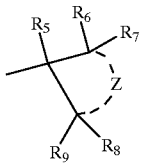

or alkyl, $R_3$ means alkyl, $R_4$ means hydrogen or $R_3$, $R_5$, $R_6$, $R_8$ and $R_9$ mean hydrogen or a substituent, $R_7$ means a substituent and Z means the remaining non-metallic members of a 3- to 8-membered ring, wherein Z may be further substituted, if a two-equivalent yellow coupler is associated with the red-sensitive layer, of which there is at least one.

The yellow coupler is preferably used in the red-sensitive layer, of which there is at least one. The quantity of yellow coupler in the red-sensitive layer is in particular 1 to 10 mol. % of the quantity of the cyan coupler of the formula (I).

The two-equivalent yellow coupler used in the red-sensitive layer preferably has a coupling rate which is no more than five times the coupling rate of the pyrrolotriazole cyan coupler. The coupling rate is determined using a method described in *J. Phot. Sci.* 36, 1988, page 14.

Two-equivalent couplers almost always couple substantially faster than cyan couplers. It would have been expected that a cyan layer of the structure according to the invention would exhibit a colour change from the lower to higher densities, with the low densities exhibiting a strong shift towards yellow or green.

Surprisingly, however, this does not occur.

Preferred two-equivalent yellow couplers are acetanilides, in particular pivaloylacetanilides and malonic anilides, the leaving groups of which are attached to the coupler molecule via O or N and which are substituted by chlorine, alkoxy or aryloxy in the ortho position of the anilide portion.

Very particularly preferred two-equivalent yellow couplers are of the formula (III):

(III)

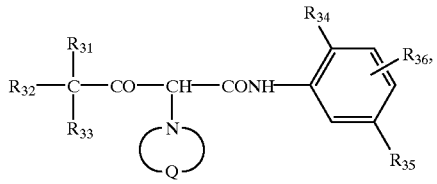

in which $R_{31}$ means alkyl, preferably having 1 to 4 C atoms, in particular methyl, $R_{32}$ means alkyl, preferably having 1 to 4 C atoms, in particular methyl, $R_{33}$ means a hydrogen atom or alkyl, preferably having 1 to 4 C atoms, in particular methyl or $R_{32}$ and $R_{33}$ together mean the remaining members of a cyclopropyl residue, $R_{34}$ means chlorine or alkoxy, $R_{35}$ means —NHCO—$R_{37}$, —$SO_2$NH—$R_{37}$, —NH$SO_2$—$R_{37}$, —COO$R_{37}$, Cl, Br or alkoxy $R_{36}$ means a hydrogen or chlorine atom, $R_{37}$ means a substituent, in particular a ballast group and Q means the remaining members of a substituted imidazole, imidazolidinedione, oxazolidinedione or triazolidinedione ring, wherein the alkyl groups may be further substituted.

In a preferred embodiment, the red-sensitive layer, of which there is at least one, additionally contains at least one N,N-disubstituted p-aminophenol ether of the formula (II)

(II)

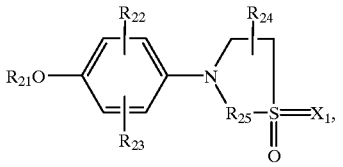

in which $R_{21}$ means an alkyl, alkenyl or aryl group, $R_{22}$ and $R_{23}$ mutually independently mean a hydrogen atom or an alkyl or alkoxy group having up to 16 C atoms, $R_{24}$ means a hydrogen atom or an alkyl group, in particular a methyl group, $R_{25}$ means a $C_1$–$C_3$ alkylene group and $X_1$ means an oxygen atom or a free electron pair, wherein alkyl groups may be further substituted.

Addition of the compounds of the formula (II) also improves the reproduction of skin tones.

There are various possible arrangements for the combined incorporation of the cyan coupler, yellow coupler and p-aminophenol ether according to the invention in a single layer: the compounds may be present in a common emulsion in at least one coupler solvent, in three separate emulsions each optionally having at least one coupler solvent and in two emulsions, wherein the preferred arrangement is that in which the cyan coupler and the p-aminophenol ether are present together in one emulsion and the yellow coupler in the other emulsion.

Suitable pyrrolo[1,2-b]-1,2,4-triazole cyan couplers of the formula (I) are:

| Nr. | $R_1$ | X | Y |
|---|---|---|---|
| I-1 | 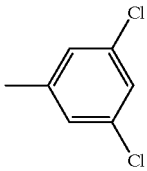 | H | 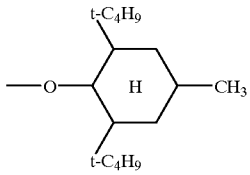 |
| I-2 | 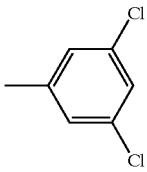 | 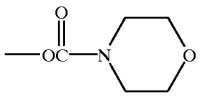 | 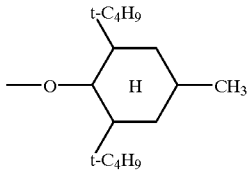 |
| I-3 | t-$C_4H_9$ | 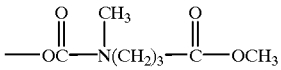 | 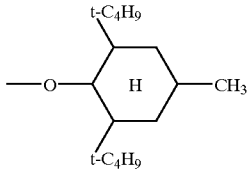 |
| I-4 | 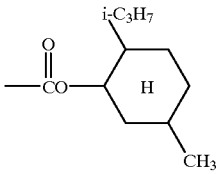 | 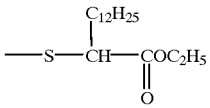 | 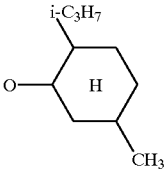 |

-continued

| Nr. | $R_1$ | X | Y |
|---|---|---|---|
| I-5 | 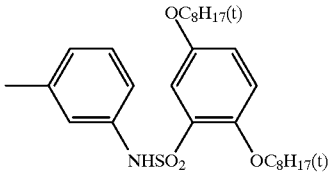 | H | 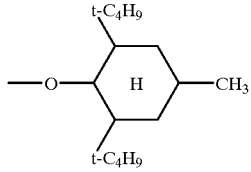 |
| I-6 | 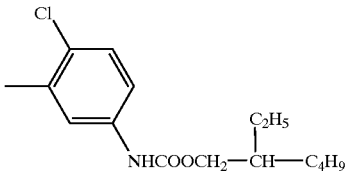 | H | $—OCH_2—CH(C_2H_5)—C_4H_9$ |
| I-7 | 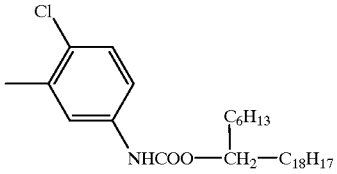 | H | $—OCH_2—CH(C_6H_{13})—C_8H_{17}$ |

Suitable compounds of the formula (II) are compounds of the following formula:

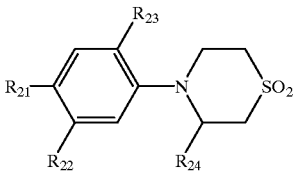

| Nr. | $R_{21}$ | $R_{22}$ | $R_{23}$ | $R_{24}$ |
|---|---|---|---|---|
| II-1 | $—OC_{12}H_{25}(n)$ | H | H | H |
| II-2 | $—OC_{14}H_{29}(n)$ | H | H | H |
| II-3 | $—OC_{16}H33(n)$ | H | H | H |
| II-4 | $—OCH_2CH(C_6H_{13}(n))—C_8H_{17}(n)$ | H | H | |
| II-5 | $—OCH_2CH_2OC(=O)OC_{12}H_{25}(n)$ | H | H | H |
| II-6 | $—OC_{12}H_{25}(n)$ | $CH_3$ | H | H |
| II-7 | $—OC_{12}H_{25}(n)$ | $OCH_3$ | H | H |
| II-8 | $—OCH_3$ | $—OC_{12}H_{25}(n)$ | H | H |
| II-9 | $—OC_{14}H_{29}(n)$ | H | H | $CH_3$ |

-continued

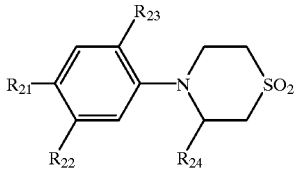

| Nr. | $R_{21}$ | $R_{22}$ | $R_{23}$ | $R_{24}$ |
|---|---|---|---|---|
| II-10 | $—OCH_2CH(C_2H_5)C_4H_9$ | H | H | H |
| II-11 | $—OC_3H_7(i)$ | $—OC_3H_7(i)$ | $—C_3H_7(i)$ | H |

The compounds of the formula (II) are in particular used in a quantity of 0.01 to 10 mol./mol. of the cyan coupler of the formula (I), preferably 0.04 to 2 mol./mol. of the cyan coupler.

Up to 25 wt. % of the cyan couplers of the formula (I) may be replaced by other cyan couplers.

Further preferred embodiments of the invention are to be found in the subordinate claims.

Suitable yellow couplers of the formula (III) are
(III-1)
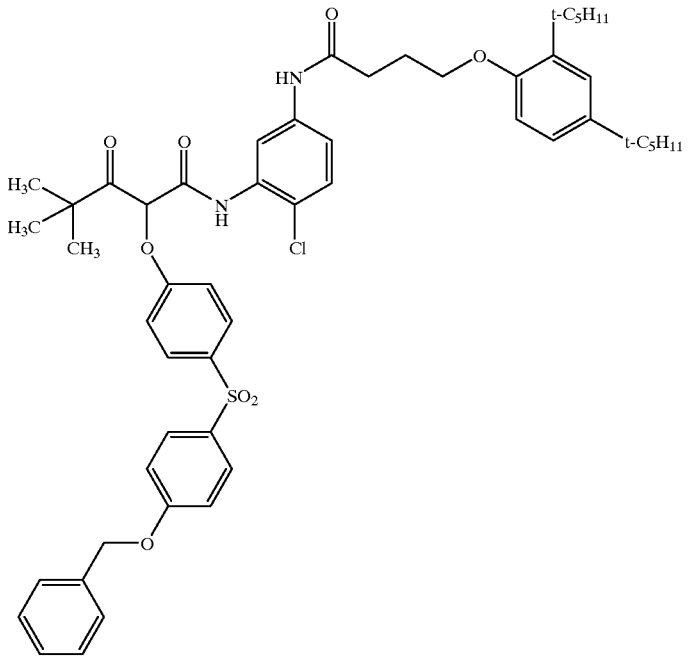
(III-2)
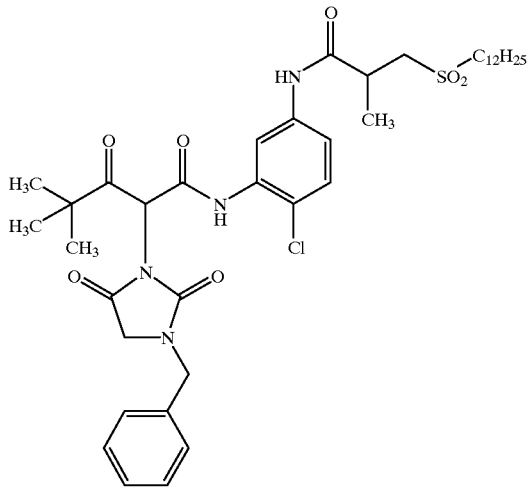

-continued
(III-3)
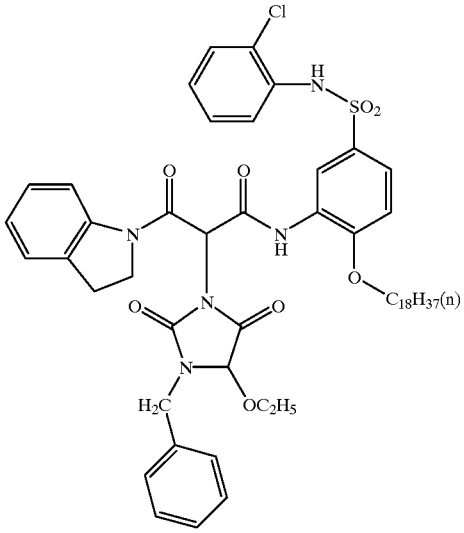
(III-4)
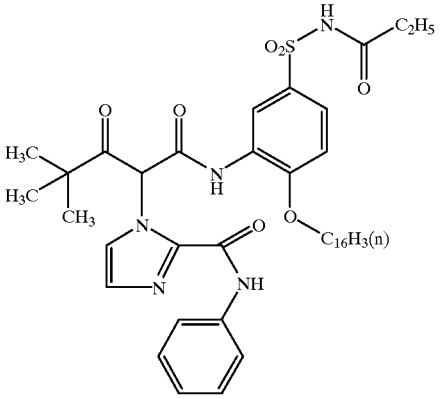
(III-5)
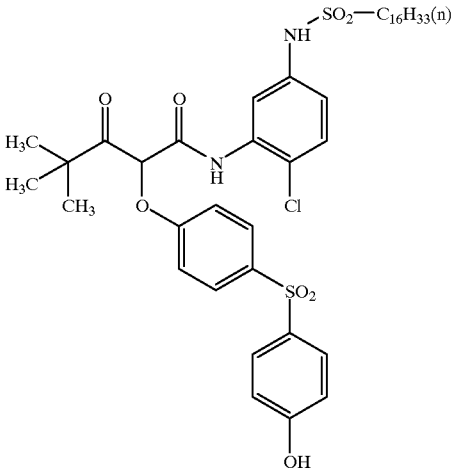

-continued
(III-6)
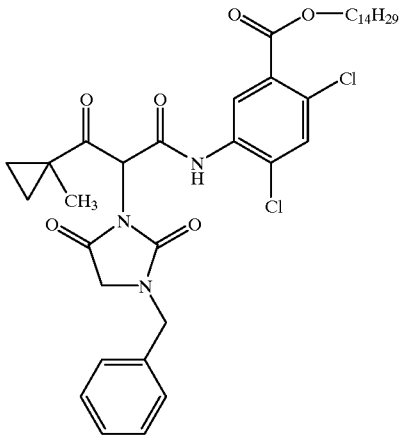
(III-7)
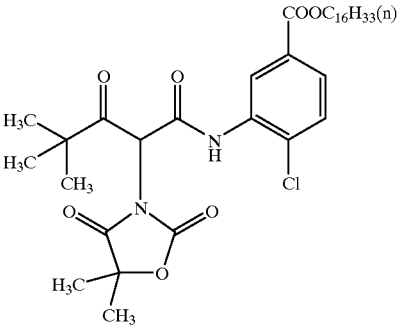
(III-8)
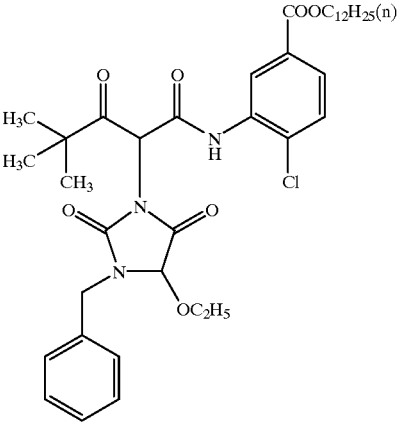

-continued (III-9)

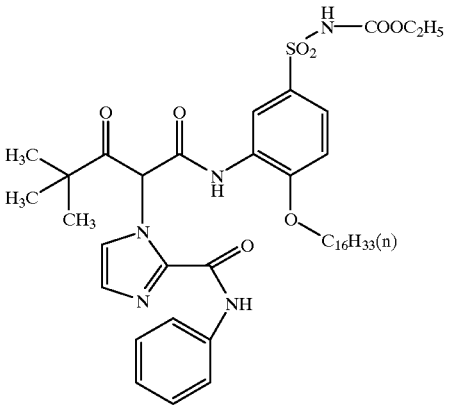

(III-10)

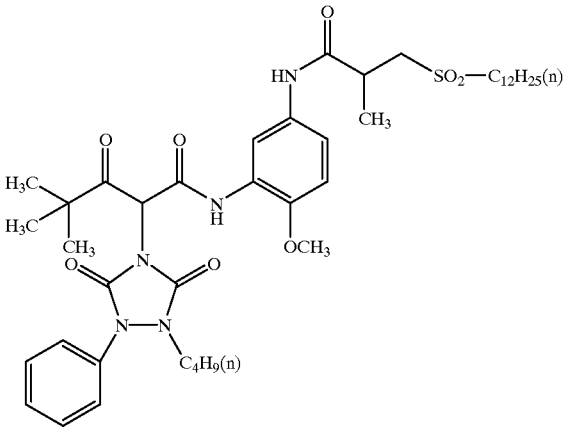

Examples of colour photographic print materials are colour photographic paper, colour reversal photographic paper and semi-transparent display material. A review is given in *Research Disclosure* 37038 (1985), *Research Disclosure* 38957 (1996) and *Research Disclosure* 40145 (1997).

The photographic print materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285 and in *Research Disclosure* 38957, part XV (1996), page 627.

The colour photographic print materials conventionally contain at least one red-sensitive, one green-sensitive and one blue-sensitive silver halide emulsion layer, optionally together with interlayers and protective layers.

Depending upon the type of the photographic print material, these layers may be differently arranged. This is demonstrated for the most important products:

Colour photographic paper and colour photographic display material conventionally have on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; a yellow filter layer is not required.

The number and arrangement of the photosensitive layers may be varied in order to achieve specific results. For example, colour papers may also contain differently sensitised interlayers, by means of which gradation may be influenced.

The substantial constituents of the photographic emulsion layers are binder, silver halide grains and colour couplers.

Details of suitable binders may be found in *Research Disclosure* 37254, part 2 (1995), page 286 and in *Research Disclosure* 38957, part II.A (1996), page 598.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89 and in *Research Disclosure* 38957, part V.A (1996), page 603.

Pentamethinecyanines having naphthothiazole, naphthoxazole or benzothiazole as basic terminal groups, which may be substituted by halogen, methyl or methoxy groups and be 9,11-alkylene, in particular 9,11-neopentylene linked, may be used as red sensitisers for the red-sensitive layer. The N,N' substituents may be $C_4$–$C_8$ alkyl groups. The methine chain may additionally also bear substituents. Pentamethines having only one methyl group on the cyclohexene ring may also be used. The red sensitiser may be supersensitised and stabilised by the addition of heterocyclic mercapto compounds.

The red-sensitive layer may additionally be spectrally sensitised between 390 and 590 nm, preferably at 500 nm, in order to ensure improved differentiation of red tones.

The spectral sensitisers may be added to the photographic emulsion in dissolved form or as a dispersion. Both solution and dispersion may contain additives, such as wetting agents or buffers.

The spectral sensitiser or a combination of spectral sensitisers may be added before, during or after preparation of the emulsion.

Photographic print materials contain either silver chloride-bromide emulsions containing up to 80 mol. % AgBr or silver chloride-bromide emulsion containing greater than 95 mol. % AgCl.

Details relating to colour couplers may be found in *Research Disclosure* 37254, part 4 (1995), page 288, in *Research Disclosure* 37038, part II (1995), page 80 and in *Research Disclosure* 38957, part X.B (1996), page 616. The maximum absorption of the dyes formed from the couplers and the developer oxidation product is preferably within the following ranges: yellow coupler 440 to 450 nm, magenta coupler 540 to 560 nm, cyan coupler 640 to 670 nm.

The yellow couplers conventionally used in print materials associated with a blue-sensitive layer are almost without exception two-equivalent couplers of the pivaloylacetanilide and cyclopropylcarbonylacetanilide series.

The magenta couplers conventional in print materials are almost without exception those from the series of anilinopyrazolones, pyrazolo[5,1-c]-(1,2,4)triazoles or pyrazolo[1,5-b]-(1,2,4)triazoles.

The non-photosensitive interlayers generally located between layers of different spectral sensitivity may contain agents which prevent an undesirable diffusion of developer oxidation products from one photosensitive layer into another photo-sensitive layer with a different spectral sensitisation.

Suitable compounds (white couplers, scavengers or DOP scavengers) may be found in *Research Disclosure* 37254, part 7 (1995), page 292, in *Research Disclosure* 37038, part III (1995), page 84 and in *Research Disclosure* 38957, part X.D (1996), pages 621 et seq.

The photographic material may also contain UV light absorbing compounds, optical brighteners, spacers, filter dyes, formalin scavengers, light stabilisers, anti-oxidants, $D_{min}$ dyes, plasticisers (latices), biocides and additives to improve the stability of dyes and couplers, to reduce colour fogging and to reduce yellowing and others. Suitable compounds may be found in *Research Disclosure* 37254, part 8 (1995), page 292, in *Research Disclosure* 37038, parts IV, V, VI, VII, X, XI and XIII (1995), pages 84 et seq. and in *Research Disclosure* 38957, parts VI, VIII, IX and X (1996), pages 607 and 610 et seq..

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294, in *Research Disclosure* 37038, part XII (1995), page 86 and in *Research Disclosure* 38957, part II.B (1996), page 599.

Once exposed with an image, colour photographic materials are processed using different processes depending upon their nature. Details relating to processing methods and the necessary chemicals are disclosed in *Research Disclosure* 37254, part 10 (1995), page 294, in *Research Disclosure* 37038, parts XVI to XXIII (1995), pages 95 et seq. and in *Research Disclosure* 38957, parts XVIII, XIX and XX (1996), pages 630 et seq. together with example materials.

EXAMPLES

Example 1

A colour photographic recording material suitable for a rapid processing process was produced by applying the following layers in the stated sequence onto a film base made from paper coated on both sides with polyethylene. Quantities are all stated per 1 $m^2$. The silver halide application rate is stated as the corresponding quantities of $AgNO_3$.

Layer Structure 1

Layer 1: (Substrate layer)
- 0.10 g of gelatine

Layer 2: (Blue-sensitive layer)
- Blue-sensitive silver halide emulsion (99.5 mol. % chloride, 0.5 mol. % bromide, average grain diameter 0.75 $\mu$m) prepared from 0.4 g of $AgNO_3$.
- 1.25 g of gelatine
- 0.50 g of yellow coupler GB-1
- 0.30 g of tricresyl phosphate (TCP)
- 0.10 g of stabiliser ST-1

Layer 3: (Interlayer)
- 0.10 g of gelatine
- 0.06 g of DOP scavenger SC-1
- 0.06 g of DOP scavenger SC-2
- 0.12g of TCP Layer 4: (Green-sensitive layer)
- Green-sensitive silver halide emulsion (99.5 mol. % chloride,
- 0.5 mol-. % bromide, average grain diameter 0.45 $\mu$m) prepared from
- 0.2 g of $AgNO_3$.
- 1.10 g of gelatine
- 0.05 g of magenta coupler PP-1
- 0.10 g of magenta coupler PP-2
- 0.15 g of stabiliser ST-2
- 0.20 g of stabiliser ST-3
- 0.40 g of TCP Layer 5: (UV protective layer)
- 1.05 g of gelatine
- 0.35 g of UV absorber UV-1
- 0.10 g of UV absorber UV-2
- 0.05 g of UV absorber UV-3
- 0.06 g of DOP scavenger SC-1
- 0.06 g of DOP scavenger SC-2
- 0.25 g of TCP Layer 6: (Red-sensitive layer)
- Red-sensitive silver halide emulsion (99.5 mol. % chloride, 0.5 mol. % bromide, average grain diameter 0.48 $\mu$m) prepared from 0.28 g of $AgNO_3$.
- 1.00 g of gelatine
- 0.40 g of cyan coupler BG-1
- 0.40 g of TCP Layer 7: (UV protective layer)
- 1.05 g of gelatine
- 0.35 g of UV absorber UV-1
- 0.10 g of UV absorber UV-2
- 0.05 g of UV absorber UV-3
- 0.15 g of TCP Layer 8: (Protective layer)
- 0.90 g of gelatine
- 0.05 g of optical brightener W-1
- 0.07 g of polyvinylpyrrolidone
- 1.20 mg of silicone oil 2.50 mg of polymethyl methacrylate spacers, average particle size 0.8 μm 0.30 g of instant hardener H-1

Layer Structure 2

Layer structure 2 differs from layer structure 1 only in layer 6.

Layer 6: (Red-sensitive layer)

Red-sensitive silver halide emulsion (99.5 mol. % chloride, 0.5 mol. % bromide, average grain diameter 0.48 μm) prepared from 0.20 g of $AgNO_3$.

1.00 g of gelatine 0.30 g of cyan coupler I-1

0.40 g of TCP

Layer Structure 3

Layer structure 3 differs from layer structure 1 only in layer 6.

Layer 6: (Red-sensitive layer)

Red-sensitive silver halide emulsion (99.5 mol. % chloride, 0.5 mol. % bromide, average grain diameter 0.48 μm) prepared from 0.20 g of $AgNO_3$.

1.00 g of gelatine 0.30 g of cyan coupler I-1

0.04 g of yellow coupler GB-1

0.40 g of TCP

Layer Structure 4

Layer structure 4 differs from layer structure 1 only in layer 6.

Layer 6: (Red-sensitive layer)

Red-sensitive silver halide emulsion (99.5 mol. % chloride, 0.5 mol. % bromide, average grain diameter 0.48 μm) prepared from 0.20 g of $AgNO_3$.

1.00 g of gelatine 0.30 g of cyan coupler I-1

0.01 g of yellow coupler GB-1

0.40 g of TCP

The following compounds are used in Example 1:

GB-1

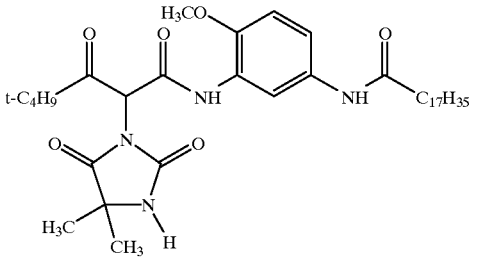

PP-1

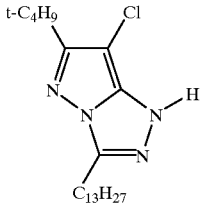

PP-2

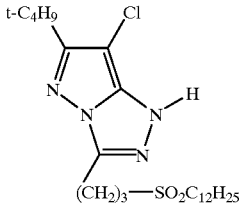

BG-1

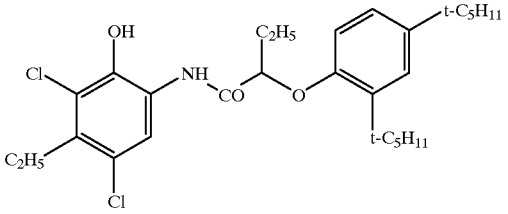

-continued
SC-1
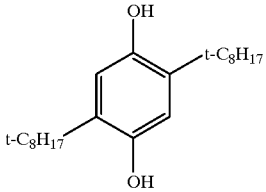
SC-2
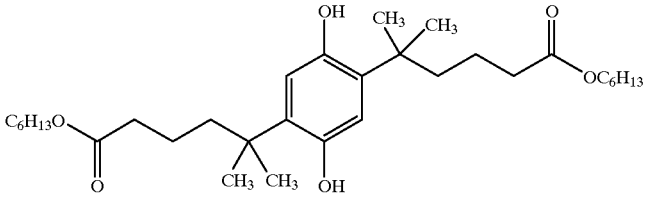
UV-1
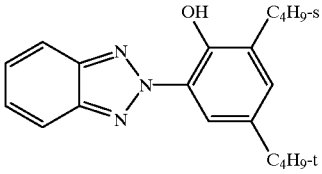
UV-2
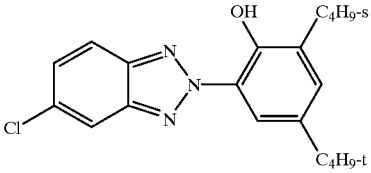
UV-3
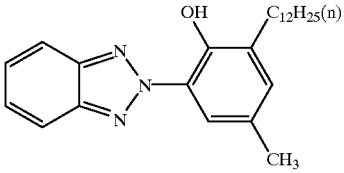
H-1
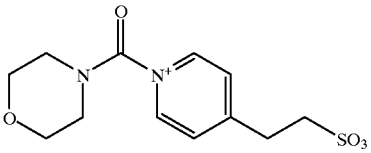
ST-1
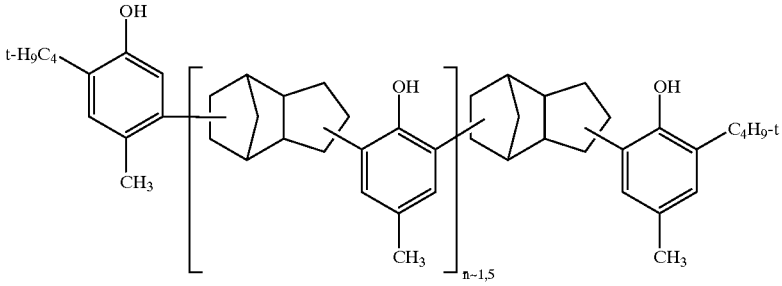

-continued

ST-2

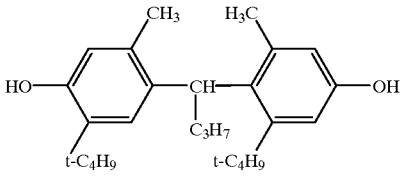

ST-3

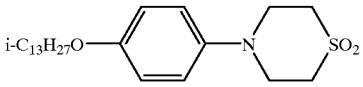

W-1

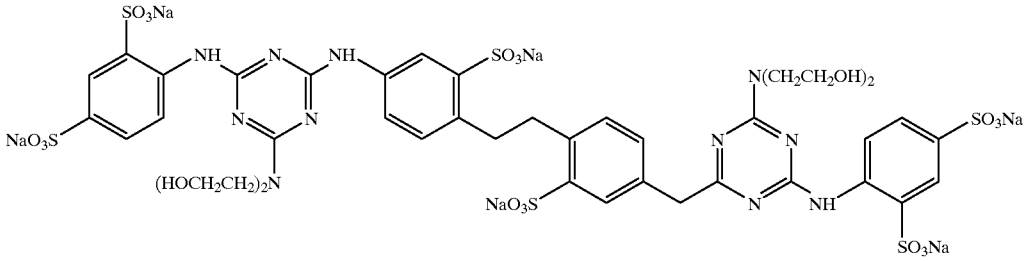

Processing:

The samples are exposed with a negative containing a recording of the MacBeth colour chart using a conventional printer, with the filtering being selected such that grey field N5 of the MacBeth colour chart is reproduced as neutral grey of a density of 0.7 in the print. Processing was performed as described below using the AP94 (Agfa) process. Colour fields #18 (cyan), #6 (bluish green), #2 (light skin) and #1 (dark skin) are then measured (Gretag SPM 100-II) on the print and the difference ΔE {CieLab system colour difference between the original and print} determined for each.

a) Colour developer - 45s - 35° C.

| | |
|---|---|
| Triethanolamine | 9.0 g |
| N,N-diethylhydroxylamine | 4.0 g |
| Diethylene glycol | 0.05 g |
| 3-methyl-4-amino-N-ethyl-N-methanesulfonamidoethyl-aniline sulfate | 5.0 g |
| Potassium sulfite | 0.2 g |
| Triethylene glycol | 0.05 g |
| Potassium carbonate | 22 g |
| Potassium hydroxide | 0.4 g |
| Ethylenediaminetetraacetic acid, disodium salt | 2.2 g |
| Potassium chloride | 2.5 g |
| 1,2-dihydroxybenzene-3,4,6-trisulfonic acid, trisodium salt | 0.3 g |
| make up to 1000 ml with water; pH 10.0 | |

b) Bleach/fixing bath - 45s - 35° C.

| | |
|---|---|
| Ammonium thiosulfate | 75 g |
| Sodium hydrogen sulfite | 13.5 g |
| Ammonium acetate | 2.0 g |
| Ethylenediaminetetraacetic acid (iron/ammonium salt) | 57 g |
| Ammonia, 25% | 9.5 g |
| make up to 1000 ml with water; adjust pH to 5.5 with ammonia (25 wt.%) or acetic acid | |

c) Rinsing - 2 min - 33° C.

d) Drying

| Layer structure | ΔE #18 | ΔE #6 | ΔE #2 | ΔE #1 | |
|---|---|---|---|---|---|
| 1 | 10.9 | 17.9 | 9.0 | 17.8 | Comparison |
| 2 | 14.5 | 19.3 | 10.2 | 18.9 | Comparison |
| 3 | 11.2 | 17.7 | 9.9 | 18.5 | Invention |
| 4 | 10.8 | 18.3 | 10.0 | 18.6 | Invention |

It is evident from the table that the impairment of colour reproduction in #18 and #6 brought about by use of a pyrrolo[1,2-b]-1,2,4-triazole cyan coupler is distinctly improved by the measure according to the invention. There is also a discernible improvement in skin tones.

Example 2

Layer structures 5-8 were produced in the same manner as layer structures 1-4 except that 0.15 g of magenta coupler PP-3/m$^2$ were used in layer 4 instead of the coupler mixture. Exposure, processing and evaluation of the samples were performed as in Example 1. It proved in this case too that addition of a yellow coupler may distinctly improve colour reproduction for #18 and #6.

| Layer structure | ΔE #18 | ΔE #6 | ΔE #2 | ΔE #1 | |
|---|---|---|---|---|---|
| 1 | 10.9 | 17.7 | 9.3 | 17.7 | Comparison |
| 6 | 15.1 | 19.6 | 10.7 | 19.1 | Comparison |

-continued

| Layer structure | ΔE #18 | ΔE #6 | ΔE #2 | ΔE #1 | |
|---|---|---|---|---|---|
| 7 | 10.6 | 18.0 | 10.3 | 18.8 | Invention |
| 8 | 11.5 | 17.6 | 10.4 | 18.5 | Invention |

Magenta coupler PP-3 is of the formula:

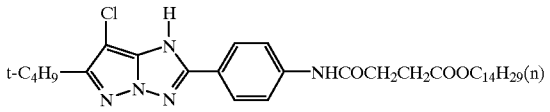

Example 3

Layer structures 9-11 are produced in same manner as layer structures 1-3. Sample 12 is identical to sample 11 except for the dye stabiliser ST-4 (0.3 g/m$^2$) additionally used in layer 6. Sample 13 is identical to sample 10 except for the dye stabiliser ST-4 (0.3 g/m$^2$) additionally used in the cyan emulsion of layer 6.

| Layer structure | ΔE #18 | ΔE #6 | ΔE #2 | ΔE #1 | |
|---|---|---|---|---|---|
| 9 | 10.8 | 18.0 | 9.1 | 17.8 | Comparison |
| 10 | 14.3 | 19.4 | 10.5 | 19.1 | Comparison |
| 11 | 11.0 | 17.6 | 9.9 | 18.7 | Invention |
| 12 | 10.9 | 17.4 | 9.0 | 17.9 | Invention |
| 13 | 14.1 | 19.6 | 10.3 | 18.9 | Comparison |

ST-4 is of the formula:

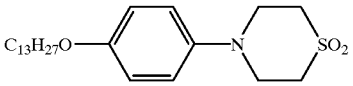

We claim:

1. A color photographic print material which comprises at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, which material contains in the red-sensitive layer, of which there is at least one, at least one pyrrolo(1,2-b)-1,2,4-triazole cyan coupler of the formula (I)

(I)

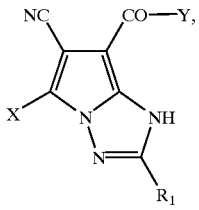

in which $R_1$ means hydrogen or a substituent,

X means a hydrogen atom or a leaving group and

Y means $OR_2$ or

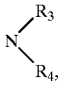

wherein $R_2$ means

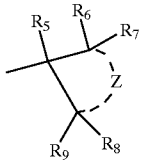

or alkyl, $R_3$ means alkyl, $R_4$ means hydrogen or $R_3$, $R_5$, $R_6$, $R_8$ and $R_9$ mean are identical or different and are hydrogen or a substituent, $R_7$ means a substituent and Z means the remaining non-metallic members of a 3- to 8-membered ring, wherein Z may be further substituted, wherein a two-equivalent yellow coupler is associated with the red-sensitive layer, of which there is at least one.

2. The color photographic print material according to claim 1, wherein said red-sensitive layer, of which there is at least one, contains at least one N,N-disubstituted p-aminophenol ether of the formula (II)

(II)

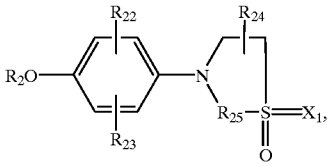

in which $R_{21}$ means an alkyl, alkenyl or aryl group, $R_{22}$ and $R_{23}$ mutually independently mean a hydrogen atom or an alkyl or alkoxy group having up to 16 C atoms, $R_{24}$ means a hydrogen atom or an alkyl group, $R_{25}$ means a $C_1$–$C_3$ alkylene group and $X_1$ means an oxygen atom or a free electron pair, wherein alkyl groups may be further substituted.

3. The color photographic print material according to claim 1, wherein the two-equivalent coupler is located in the red-sensitive layer, of which there is at least one, and is of the formula (III)

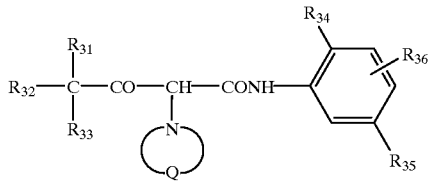

in which $R_{31}$ means alkyl, $R_{32}$ means alkyl, $R_{33}$ means a hydrogen atom or alkyl, or $R_{32}$ and $R_{33}$ together mean the remaining members of a cyclopropyl residue, $R_{34}$ means chlorine or alkoxy, $R_{35}$ means —NHCO—$R_{37}$, —$SO_2$NH—$R_{37}$, —$NHSO_2$—$R_{37}$, —$COOR_{37}$, Cl, Br or alkoxy $R_{36}$ means a hydrogen or chlorine atom, $R_{17}$ means a substituent and Q means the remaining members of a substituted imidazole, imidazolidinedione, oxazolidinedione or triazolidinedione ring, wherein the alkyl groups may be further substituted.

4. The color photographic print material according to claim 2, wherein the two-equivalent coupler is used in a quantity of 0.01 to 0.1 mol. and the p-aminophenol ether in a quantity of 0.01 to 10 mol., each relative to 1 mol. of the cyan coupler of the formula (I).

5. The color photographic print material according to claim 1, wherein $R_1$ means a hydrogen atom, an alkyl group or an unsubstituted or substituted phenyl group Y means $OR_2$

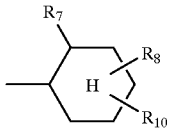

$R_7$ and $R_8$ independently of one another mean $C_1$–$C_6$ alkyl $R_9$ means a hydrogen atom or $C_1$–$C_6$ alkyl and X means a hydrogen atom, a chlorine atom or a leaving group attached via O or S.

6. The color photographic print material according to claim 2, wherein the p-aminophenol ether is of the formula

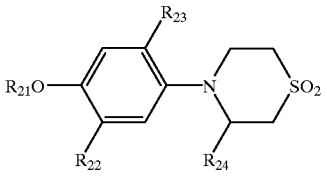

in which $R_{21}$ means $C_1$–$C_{20}$ alkyl, $R_{24}$ means hydrogen or methyl and $R_{22}$ and $R_{23}$ have the meaning stated in claim 2, wherein the total number of carbon atoms in the residues $R_{21}$, $R_{22}$ and $R_{23}$ is at least 8.

7. The color photographic print material according to claim 3, wherein $R_{31}$ and $R_{32}$ means methyl, $R_{33}$ means hydrogen or methyl or $R_{32}$ and $R_{33}$ together mean cyclopropyl, $R_{34}$ means chlorine or alkoxy having up to 20 C atoms, $R_{35}$ means —NHCO—$R_{37}$, —$SO_2$NH—$R_{37}$, —$NHSO_2R_{37}$ or $COOR_{37}$, $R_{36}$ means hydrogen or chlorine $R_{37}$ means a ballast group and Q means the remaining members of a substituted imidazole, imidazolidinedione, oxazolidinedione or triazolidinedione ring.

8. The color photographic material according to claim 1, wherein a yellow coupler is used in the red-sensitive layer in the quantity from 1 to 10 mol. % of the quantity of the cyan coupler of the formula (I).

9. The color photographic print material according to claim 8, wherein the yellow coupler is acetanilide.

10. The color photographic print material according to claim 3, wherein $R_{31}$ is a $C_1$–$C_4$-alkyl;

$R_{32}$ is a $C_1$–$C_4$-alkyl;

$R_{33}$ is hydrogen or a $C_1$–$C_4$-alkyl and $R_{37}$ is a ballast group.

11. The color photographic print material according to claim 10, wherein $R_{31}$, $R_{32}$ and $R_{33}$ are methyl.

12. The color photographic print material according to claim 2, wherein $R_{22}$, $R_{23}$ and $R_{24}$ are H and $R_{21}$ is an alkyl.

* * * * *

UNITED STATES PATENT AND TRADEMARK OFFICE

CERTIFICATE OF CORRECTION

PATENT NO. : 6,171,773 B1
DATED : January 9, 2001
INVENTOR(S) : Peter Bergthaller et al.

It is certified that error appears in the above-identified patent and that said Letters Patent is hereby corrected as shown below:

Claim 2,
Line 45 please delete formula (II)

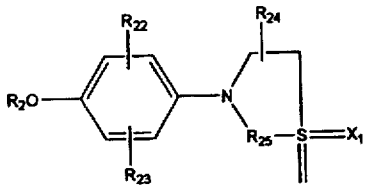

(II), and insert the following formula (II)

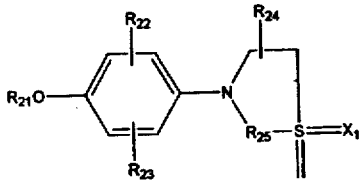

(II),

Claim 5,
Line 40 should read $R_2$ means 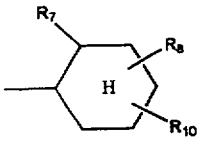 or $C_6$-$C_{20}$-alkyl,

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*